US008323165B2

(12) United States Patent
Atoui

(10) Patent No.: US 8,323,165 B2
(45) Date of Patent: Dec. 4, 2012

(54) METHOD FOR FORMING A CONTAINER

(75) Inventor: Marc Atoui, Reedley, CA (US)

(73) Assignee: Thiele Technologies, Inc., Minneapolis, MN (US)

( * ) Notice: Subject to any disclaimer, the term of this patent is extended or adjusted under 35 U.S.C. 154(b) by 401 days.

(21) Appl. No.: 12/559,412

(22) Filed: Sep. 14, 2009

(65) Prior Publication Data

US 2011/0065559 A1 Mar. 17, 2011

(51) Int. Cl.
*B31B 1/28* (2006.01)

(52) U.S. Cl. ..... 493/175; 493/89; 493/391; 493/76; 493/79

(58) Field of Classification Search ..... 53/89, 90, 53/175, 391, 76, 79
See application file for complete search history.

(56) References Cited

U.S. PATENT DOCUMENTS

| | | | |
|---|---|---|---|
| 1,697,709 | A | 1/1929 | Bliss |
| 1,974,527 | A | 9/1934 | Bliss |
| 3,059,753 | A | 10/1962 | Lisinksi |
| 3,186,244 | A | 6/1965 | Baker |
| 3,196,761 | A | 7/1965 | Ullman |
| 3,318,205 | A | 5/1967 | Lefief |
| 3,456,563 | A | 7/1969 | Roesner et al. |
| 3,465,652 | A | 9/1969 | Bell et al. |
| 3,521,536 | A | 7/1970 | Waldbauer et al. |

(Continued)

FOREIGN PATENT DOCUMENTS

CA 2175878 12/1996

OTHER PUBLICATIONS

Fibre Box Association; Fibre Box Handbook; 1992; pp. 17-32D ("box styles"), pp. 10-11 ("box manufacturing").

(Continued)

*Primary Examiner* — Hemant M Desai
(74) *Attorney, Agent, or Firm* — Marcus N. DiBuduo; Mark D. Miller

(57) ABSTRACT

Systems, apparatuses, and methods for forming a Bliss-type container having main portion with side and bottom flaps and a side support portion. Systems can include a mandrel movably mounted on a path, a hopper providing the side support portion, a feeder providing the main portion, and a folding assembly configured to fold the side flaps over the support portion. The systems may further include a plurality of plows and compression plates for bending side panels of the main portion, the side support portion, and the bottom flaps over the mandrel. Methods can include moving a mandrel forward along a path inside a machine, engaging the side support portion on a first side of the mandrel, and engaging a bottom panel of the main portion on a front of the mandrel such that an edge of the support portion is aligned against said bottom panel. Side panels of the main portion may be bent over opposing sides of the mandrel which are generally perpendicular to the first side of the mandrel. After the side panels are bent, the side flaps may be bent over the first side of the mandrel by a plurality of folding members having extended and retracted positions. Apparatuses can include a folding member on a frame having an opening for receiving a mandrel. The folding member may have a portion movable in a direction generally orthogonal to a direction of movement of the mandrel, and may be configured to fold the side flaps between about 30 to 90 degrees towards the side support portion.

20 Claims, 7 Drawing Sheets

U.S. PATENT DOCUMENTS

| | | | | | |
|---|---|---|---|---|---|
| 3,583,295 | A | | 6/1971 | Elder et al. | |
| 3,590,700 | A | | 7/1971 | Paxton | |
| 3,626,819 | A | * | 12/1971 | Hoyrup | 493/132 |
| 3,635,129 | A | | 1/1972 | Cobelo, Jr. | |
| 3,638,537 | A | | 2/1972 | Cato | |
| 3,659,505 | A | * | 5/1972 | Wasyluka et al. | 493/102 |
| 3,808,959 | A | | 5/1974 | Perry | |
| 3,821,875 | A | | 7/1974 | Paxton | |
| 3,858,489 | A | | 1/1975 | Paxton | |
| 3,935,798 | A | | 2/1976 | Paxton | |
| 3,941,037 | A | | 3/1976 | Reichert | |
| 3,952,635 | A | | 4/1976 | Mims | |
| 4,023,471 | A | * | 5/1977 | Royal | 493/114 |
| 4,197,789 | A | | 4/1980 | Moen | |
| 4,201,118 | A | | 5/1980 | Calvert | |
| 4,273,322 | A | | 6/1981 | Ginther, Sr. et al. | |
| 4,283,188 | A | | 8/1981 | Wingerter et al. | |
| 4,285,679 | A | | 8/1981 | Wahle | |
| 4,348,853 | A | | 9/1982 | Morse et al. | |
| 4,398,901 | A | * | 8/1983 | Campbell | 493/90 |
| 4,557,472 | A | | 12/1985 | Hannon | |
| 4,581,005 | A | * | 4/1986 | Moen | 493/167 |
| 4,596,542 | A | * | 6/1986 | Moen | 493/89 |
| 4,601,687 | A | * | 7/1986 | Gallaher | 493/89 |
| 4,798,571 | A | | 1/1989 | Everman et al. | |
| 4,807,428 | A | | 2/1989 | Boisseau | |
| 4,969,861 | A | | 11/1990 | Crittenden | |
| 4,988,331 | A | | 1/1991 | Boisseau | |
| 5,057,066 | A | | 10/1991 | Nagahashi | |
| 5,104,368 | A | | 4/1992 | Arbuthnot | |
| 5,156,583 | A | | 10/1992 | Baas | |
| 5,312,316 | A | | 5/1994 | Wu | |
| 5,419,485 | A | | 5/1995 | Petriekis et al. | |
| 5,656,006 | A | * | 8/1997 | East et al. | 493/171 |
| 5,656,007 | A | | 8/1997 | Olson et al. | |
| 5,807,223 | A | * | 9/1998 | Holton | 493/84 |
| 5,876,319 | A | * | 3/1999 | Holton | 493/84 |
| 6,000,525 | A | | 12/1999 | Frulio | |
| 6,309,335 | B1 | * | 10/2001 | Holton | 493/122 |
| 6,357,654 | B1 | * | 3/2002 | Gardner et al. | 229/122.32 |
| 6,520,898 | B1 | * | 2/2003 | Moen | 493/52 |
| 2002/0013204 | A1 | * | 1/2002 | Plemons et al. | 493/80 |
| 2004/0056081 | A1 | * | 3/2004 | Christensen et al. | 229/122.26 |
| 2008/0081754 | A1 | * | 4/2008 | Plemons et al. | 493/84 |

OTHER PUBLICATIONS

SWF Machinery; Corrugated and Solid Fibre Tray and Bliss Box Forming Machines; on or before Mar. 1, 1996.

SWF Machinery; Bliss Matic (brochure); on or before Mar. 1, 1996.

SWF Machinery; Bliss Designs That Display (flyer); on or before Mar. 1, 1996.

* cited by examiner

METHOD FOR FORMING A CONTAINER

BACKGROUND OF THE INVENTION

1. Field of the Invention

The present invention is generally related to container forming machines. More particularly, embodiments of the present invention pertain to systems, apparatuses, and methods for forming and erecting Bliss-style containers from precut material blanks.

2. Background and Description of Related Art

There is an ever increasing need for better containers to hold commodities having various sizes, shapes and dimensions such as fresh fruits and vegetables, canned and bottled goods, and a wide variety of other products. As new products are developed, new requirements for packing, shipping and storing various quantities of such products arise. Every time such requirements arise, or a new product is developed, there is a need for a new container design, as well as a machine to manufacture it.

In the packaging industry, numerous fiberboard containers and designs have been developed over the years. Such containers are typically constructed of a corrugated material. These materials may be single face corrugated, single wall (double-faced) corrugated, double wall corrugated, triple wall corrugated, etc. Containers may also be made of other paperboard products including, without limitation, container board, boxboard, linerboard, and cardboard.

Many different container box styles and types have also been developed over the years, each being optimally suited for one or more particular products or industries. Slotted box styles include such types as regular slotted containers (RSC), overlapped slotted containers (OSC), full-overlapped slotted containers (FOL), center special slotted containers (CSSC), bag-in-box containers, center special overlapped slotted containers (CSO or CSOSC), center special full-overlapped slotted containers (SFF), and snap-bottom boxes, among others. Telescoping boxes include such types as full-telescope design-style boxes (FTD), full-telescope half-slotted boxes (FTHS), partial-telescope design-style boxes (PTD), partial-telescope half-slotted boxes (PTHS), design-style boxes with cover (SDC), half-slotted boxes with cover (HSC), double-covered boxes (DC), interlocking-covered boxes (IC), bulk bins, and double-thickness score-line boxes, among others. Folder style boxes include such types as one-piece folders (1PF), two-piece folders (2PF), three-piece folders (3PF), four-piece folders (4PF), wrap-around blanks, self-locking trays, tuck folders, and one-piece telescopes (1PT) among others. Slide-type boxes include such types as double-side boxes (DS), and triple-side boxes (TS), among others. Rigid boxes include Bliss boxes and recessed-end boxes, among others. There are also self-erecting boxes, and numerous interior forms for boxes.

In the industry, the terms "case" and "box" are often used interchangeably. These terms each refer to a large, usually rectangular container made out of paperboard which is designed to hold a given number (e.g. 12 or 24) of smaller units such as cartons, bottles, cans, or produce pieces.

Bliss-type boxes have special characteristics which make them highly desirable for use in bulk packing industries such as meats, explosives, fresh fruits and vegetables, and other areas where strong construction and stacking strength are important. Bliss boxes were first developed in the 1920s, and were the subject of a number of early U.S. patents (e.g. U.S. Pat. Nos. 1,697,709 and 1,974,527). Generally speaking, a Bliss box is made of three distinct pieces of paperboard material. The first is an elongated piece of material, sometimes called a body matt (or main blank or main part), which is folded around itself in the shape of a rectangular tube forming the bottom, sides and top of the final box. In some Bliss-type boxes, separate end panels, usually mirror-images of each other, are attached to the open end of the larger piece to form the completed Bliss box. The corners of the side panels typically fold over the corners of the front and back panels of the body matt on the outside, giving the Bliss style of box good corner and stacking strength. The bottom of the Bliss box is generally solid which avoids the need for bottom sealing.

Because of its three-part construction, Bliss style boxes offer a wide range of variations in both construction and materials. For example, the end panels may or may not include upper flaps for closing the top of the box. The body matt may include two large flaps (one on either side) to form the top of the box so that these flaps either meet or overlap; or, there may be only one large top flap (with or without a tuck-in lip) provided to form the top of the Bliss box. Top flaps from the side panels may or may not be provided, or some other suitable combination of large or small flaps from the side panels and body matt may be employed.

Similarly, the corner-area overlaps provided by the side panels may vary widely depending upon the degree of strength required. In some Bliss box variations, flaps are provided along the sides of the body matt so that, when the body matt is folded over itself, these flaps create a frame on either end to which the side panels may be attached (on the inside of the body matt). This way, instead of side-panel flaps overlapping the outside of the body matt corners for attachment and strength, body matt flaps in these corners overlap the side panels. Such frames may be made with panels along both sides as well as the bottom end of the body matt. In many cases, the side panels and the body matt may be made of different paperboard materials (e.g., corrugated body matt and linerboard side panels). The overlapping areas of Bliss boxes are generally glued together, but may also be adhered using staples, rivets, or other similar attachment devices.

The process of manufacturing Bliss boxes first requires the creation of the three pieces of the box. The size and shape of the final box is determined by the dimensions of these pieces which are, in turn, determined by the ultimate product to be placed therein. Once these dimensions are determined, the appropriate method and amount of top flap overlap is determined, as well as the manner and amount of attachment of the side panels to the body matt.

Special Bliss box forming machines have been developed over the years to assemble these three paperboard pieces into the completed Bliss box. Different styles of such container-forming machines have been in existence for many years; however, such machines are generally limited to forming only the most basic of the many possible variations of Bliss boxes.

The need has now arisen for a container in which the main blank has flaps, extending from the side panels, for folding and completing the ends of a box. In contrast to conventional Bliss boxes where end panels are used to attach to and wrap around edges of the side panels, side support parts are provided inside the formed body matt such that the side panel flaps overlap the side support parts. The side support parts provide increased structural integrity as opposed to that offered by end panels, while at the same time eliminating the possibility that the end panels will detach from the side panels resulting to carton failure. Further structural stability can be provided by bottom flaps, extending from the bottom panel, for folding over the side flaps.

Unfortunately, conventional forming machines are incapable of forming such a special reinforced container, in part because of the order in which the various portions of the box are formed; mainly, the bottom flaps are folded over the side flaps which are folded over the support parts.

Therefore, there is a need for systems, apparatuses, and methods that can form a Bliss style container having side flaps extending from side panels, bottom flaps extending from a bottom panel, and side support parts.

SUMMARY OF THE INVENTION

Embodiments of the present invention provide apparatuses, systems and methods for forming a container. In general, one or more retractable folding members can be configured to fold side flaps of the main part of the container over the support part so as not to interfere with yet unfolded bottom flaps as the container is moving on a mandrel.

In some embodiments of the present invention, a system for forming a container can include a mandrel movable between a hopper for supplying a support blank of the container to be formed and a compression plate, a feeder located between the hopper and the compression plate for supplying a main blank of the container to be formed, the main blank comprising side panels and a bottom panel, and a folding assembly located between the feeder and the compression plate. The system may form the support blank on the mandrel before the side panels and bottom panel of the main blank are bent against the formed support blank. The folding assembly may bending side flaps of the side panels against the support blank before a bottom flap of the bottom panel is folded over the side flaps.

In some embodiments of the present invention, a system for forming a Bliss-type container can include: a) a mandrel movably mounted on a path and capable of oscillating motion between a beginning and an end of the path; b) a hopper at a first location along the path for providing a support blank of the container at a first side of the mandrel; c) a feeder at a second location along the path between the first location and the end for providing a main blank of the container at a forward end of the mandrel; and d) a folding assembly at a third location along the path between the second location and the end for bending a first side flap of the main blank and a second side flap of the main blank against the support blank.

In some embodiments, the folding assembly can be configured to hold the side flaps against the support blank while a bottom flap of the main blank is folded over the side flaps. In some embodiments, the system can further include a side compression plate at a fourth location along the path between the third location and the end for applying a compressing force to the bottom flap, the side flaps, and the support blank. In some embodiments, the side compression plate can be configured to fold the bottom flap over the side flaps.

In some embodiments, the folding assembly can include at least two folding elements with extended positions for contacting the side flaps after the forward end of the mandrel moves past the third location towards the end. In some embodiments, the folding assembly can further include one of the group consisting of a cylinder, a cable, a mechanical lever, a rotor, and combinations thereof in operable communication with the at least two folding elements and adapted to extend and to retract the at least two folding elements. In some embodiments, the folding assembly can further include a frame defining an opening adapted to receive the mandrel and wherein the folding elements are mounted on the frame. In some embodiments, the folding elements can be configured to retract from the extended positions when the forward end of the mandrel is near the end of the path.

In some embodiments of the present invention, a system can form a container from (i) a main blank having two side panels each having a pair of side flaps, and a bottom panel having a pair of bottom flaps, and (ii) a pair of side support blanks. In some embodiments, the system can include: a) a mandrel movably mounted on a path and capable of oscillating motion between a beginning and an end of the path, the mandrel having a front side, a pair of first opposing sides, and a pair of second opposing sides, wherein the first opposing sides are generally perpendicular to the second opposing sides; b) a pair of hoppers at a first location along the path configured to provide the side support blanks on the first opposing sides of the mandrel; c) at least one plow at a second location along the path between the first location and the end for bending the side support blanks against the second opposing sides of the mandrel; d) a feeder at a third location along the path between the second location configured to provide the main blank at the front side of the mandrel; e) plows at a fourth location along the path between the third location and the end for bending the side panels against the second opposing sides of the mandrel; f) a folding assembly at a fifth location along the path between the fourth location and the end for to bending the side flaps against the side support blanks; and g) a pair of compression plates at a sixth location along the path between the fifth location and the end for applying a compressing force to the side bottom flaps, the side flaps, and the side support blanks.

In some embodiments, the folding assembly can include a plurality of folding elements, each of the folding elements configured to extend from retracted positions after the forward end of the mandrel moves past the fifth location towards the end. In some embodiments, one of the group consisting of the compression plates, a plurality of plows at a seventh location between the fifth and the sixth location, and combinations thereof can be configured to fold the bottom flaps over the side flaps, wherein the bottom flaps have a folding direction generally perpendicular to a folding direction of the side flaps. In some embodiments, the folding elements can be configured to retract from the extended positions after the forward end of the mandrel moves past one of the sixth location or the seventh location. In some embodiments, the folding elements can include an extendable finger in operable communication with one of the group consisting of a cylinder, a cable, a mechanical lever, and combinations thereof.

In some embodiments of the present invention, an apparatus can bend a side flap of a main part of a container against a side support part of the container. In some embodiments, the apparatus can include a folding member on a frame having an opening for receiving a mandrel, the folding member having a portion movable in a direction generally orthogonal to a direction of movement of the mandrel, wherein the movable portion of the folding member is configured to bend the side flap between about 30 degrees and about 90 degrees towards the side support part.

In some embodiments, the folding member can include an extendable finger in operable communication with one of the group consisting of a cylinder, a cable, a mechanical lever, and combinations thereof. In some embodiments, the folding member can include an arm rotatable about an axis generally parallel to the direction of movement of the mandrel.

In some embodiments, the main part can further include a bottom flap, and the apparatus can further include a plate for bending the bottom flap between about 30 degrees to about 90 degrees against the folded side flap. In some embodiments, the folding member can be configured to hold the side flap against the side support part until the bottom flap is folded over the side flap.

In some embodiments, the frame can be coupled to a feeder for providing the main part and a hopper providing the side support part. In some embodiments, the main part can further include a side panel, and the frame can further include a plurality of plows for bending the side panels. In some embodiments, the mandrel can have a side configured to receive the side support part and an end configured to receive the main part, and wherein the main mandrel is configured to push the main part against the plows and through the frame.

In some embodiments of the present invention, a container can be formed from (i) a main blank having at least two side panels with side flaps and a bottom panel, and (ii) support blank. In some embodiments, a method can include the steps of: a) moving a mandrel forward along a path inside a machine; b) engaging the support blank on a first side of the mandrel as the mandrel travels forward on the path; c) engaging the bottom panel on a front of the mandrel as the mandrel travels forward on the path such that an edge of the support blank is aligned against the bottom panel; d) bending the side panels against opposing sides of the mandrel with at least one plow as the mandrel travels forward on the path, wherein the opposing sides of the mandrel are generally perpendicular to the first side of the mandrel; and e) after the side panels are bent, bending the side flaps against the first side of the mandrel by a plurality of folding members having extended and retracted positions.

In some embodiments, the bottom panel can have a bottom flap, and the method can further include the steps of folding the bottom flap over the side flaps while the folding members have the extended positions. In some embodiments, the method can further include the step of applying a compressing force to the bottom flap, the side flaps, and the support blank by a compression plate. In some embodiments, the method can further include the step of retracting the folding members after the compression plate has applied the compression force. In some embodiments, the bottom flap can be folded over the side flap one of the group consisting of a front edge of the compression plate, at least one plow, and combinations thereof.

In some embodiments, the step of engaging the support blank on the first side of the mandrel can include the steps of placing the support blank on a the first side of the mandrel by a hopper and bending the support blank against at least one adjacent side of the mandrel. In some embodiments, the step of engaging the bottom panel on the front of the mandrel can include the steps of placing the bottom panel of the main blank in the path of the front of the mandrel by a feeder. In some embodiments, the step of bending the side flaps comprises the steps of extending the folding member to contact outside surfaces of the side flaps, further extending the folding members in a direction towards the support part, and holding the side flaps against the support part until a bottom flap of the bottom panel is folded over the side flaps. In some embodiments, the method can further include the step of retracting the folding members after the bottom flap is folded over the side flaps.

In some embodiments of the present invention, a container can be formed from (i) a main blank having at least two side panels with side flaps and a bottom panel with bottom flaps, and (ii) two support blanks. In some embodiments, a method can include the steps of: a) first, engaging the support blanks on first opposing sides of a mandrel movable along a path inside a machine by placing the support blanks on the opposite sides of the mandrel by a hopper and bending each of the support blanks against adjacent sides of the mandrel; b) then, engaging the bottom panel on a front of the mandrel by placing the bottom panel in the path of the mandrel moving in a forward direction by a feeder, wherein forward edges of the support blanks are aligned against an inside surface of the bottom panel; c) then, bending the side panels against second opposing sides of the mandrel with at least two plows as the mandrel travels forward on the path, wherein the second opposing sides of the mandrel are generally perpendicular to the first opposing sides of the mandrel; d) then, bending the side flaps against the first opposing sides of the mandrel by extending a plurality of retractable members to contact outside surfaces of the side flaps and further extending the retractable members in a direction towards the support parts; and e) then, while maintaining the retractable members in an extended position, folding the bottom flaps over the side flaps and compressing the bottom flaps, the side flaps, and the support parts.

In some embodiments of the present invention, a container can be formed from (i) a main blank having at least two side panels each having at least two side flaps and a bottom panel having at least two bottom flaps and (ii) at least two side support blanks having a main panel and at least two flaps. In some embodiments, the method can include the steps of: a) first, bending the flaps of the side support blanks at angles of between about 30 degrees to about 90 degrees; b) then, aligning edges of the side support blanks against an inside surface of the bottom panel of the main blank; c) then, bending the side panels of the main blank at angles of between about 30 degrees to about 90 degrees, wherein an inside surface of the side panels are flush against an outside surface of the flaps of the side support blanks; d) then, bending the side flaps of the main blank at angles of between about 30 degrees to about 90 degrees, wherein an inside surface of the side flaps are flush against an outside surface of the main panel of the side support blanks; e) then, bending the bottom flaps of the main blank at angels of between about 30 degrees to about 90 degrees, wherein an inside surface of the bottom flaps are flush against an outside surface of the side flaps of the main blank.

The present invention thus provides systems, apparatuses, and methods where a Bliss style container having a main part with side and bottom flaps can be constructed, wherein the side flaps may be folded over one or more support parts positioned inside the container, without impeding movement of the container on said mandrel caused by yet unfolded bottom flaps.

These and other objects, advantages, and features of the invention, together with the organization and manner of operation thereof, will become apparent from the following detailed description when taken in conjunction with the accompanying drawings, wherein like elements have like numerals throughout the several drawings described below.

DETAILED DESCRIPTION

Figure 1A:
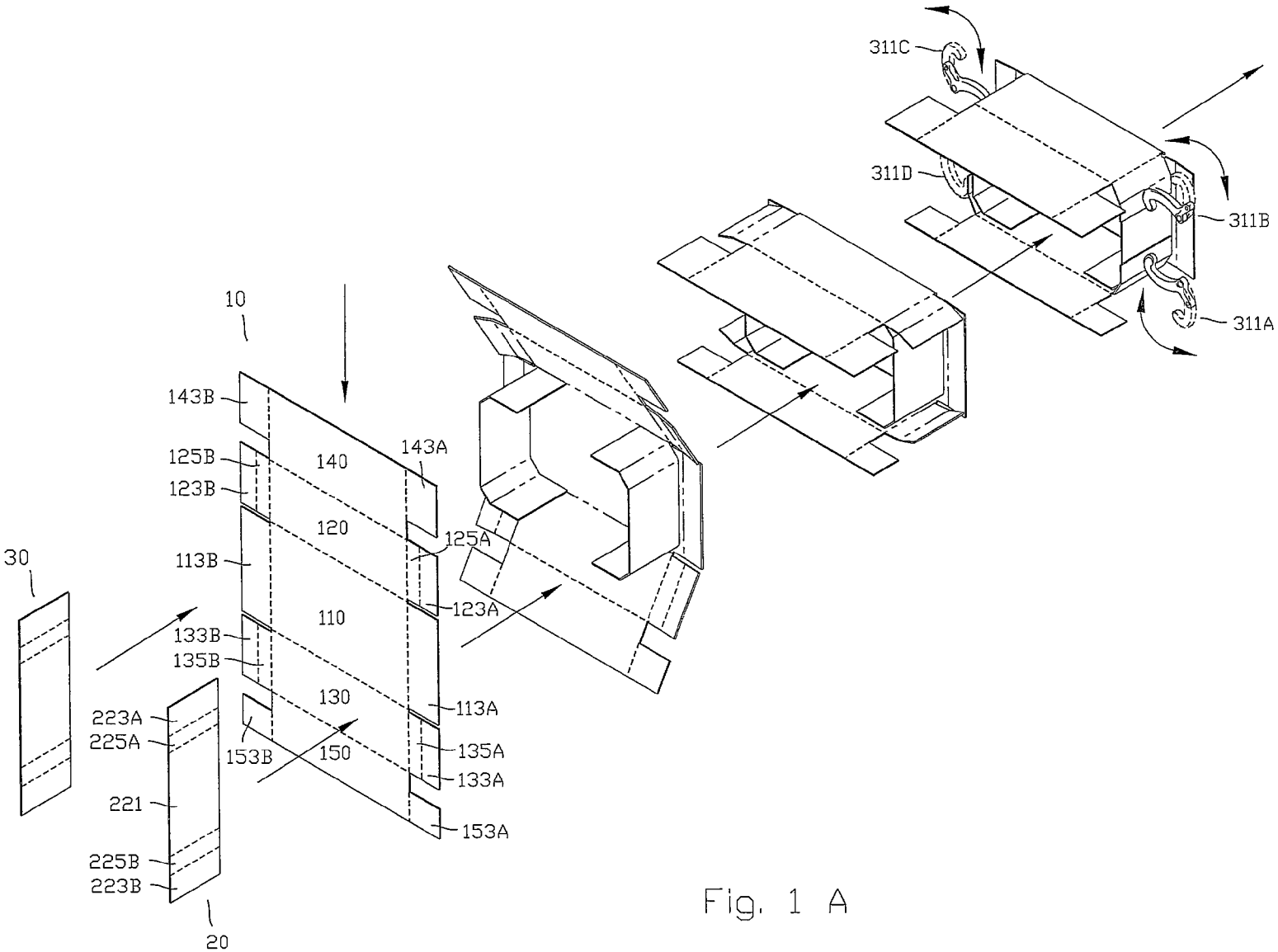
FIGS. 1A-1B are progression series showing a container formed in accordance with some embodiments of the present invention.

The invention, in its various aspects, will be explained in greater detail below. While the invention will be described in conjunction with several exemplary embodiments, the exemplary embodiments themselves do not limit the scope of the invention. Similarly, the exemplary embodiments as illustrated in the accompanying drawings, wherein like or similar reference characters designate like or corresponding parts throughout the several views and examples, do not limit the scope of the exemplary embodiments and/or of the invention. Rather the invention, as defined by the claims, may cover alternatives, modifications, and/or equivalents of the exemplary embodiments.

Figure 1B:
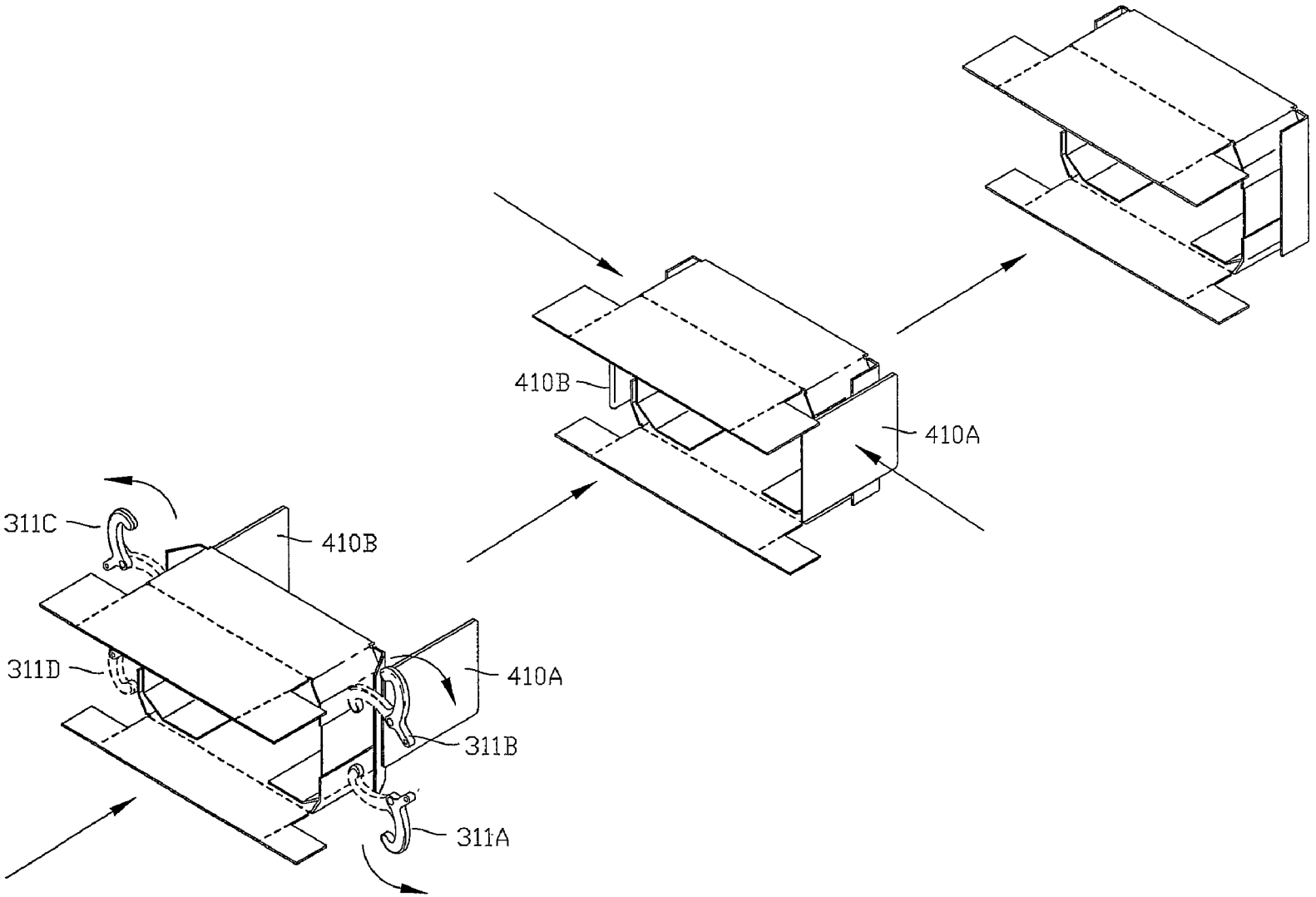

Referring to the drawings wherein like reference characters designate like or corresponding parts throughout the several views, and referring particularly to FIGS. 1A-1B it is seen that a container can include a main blank 10 and at least one side support blank 20.

In some examples, and without limitation, main blank 10 can have a bottom panel 110, a first side panel 120, a second side panel 130. In some examples, main blank 10 may also have a first top panel 140 and a second top panel 150. When formed, bottom panel 110, side panels 120 and 130, and top panels 140 and 150 correspond to the bottom, side, and top portions of the container, respectively. In some examples, and without limitation, the individual panels of main blank 10 may have a rectangular shape, however it is to be appreciated that other shapes are contemplated in accordance with some embodiments of the present invention. Further, while the individual panels of main blank 10 as illustrated in FIGS. 1A-1B corresponds to a rectangular bliss container (for example, having a length that is not equal to a width), it is to be appreciated that the bliss container may be square in shape (for example, having a length that is equal to a width). Those in the art can appreciate that the shape of the panels are dictated by the desired shape of the container to be formed.

In some embodiments, main blank 10 can further have flaps extending from one or more panels to form the ends of the container. In some examples, and without limitation, bottom panel 110 may have bottom flaps 113A and 113B on opposite ends. In some examples, and as illustrated by exemplary bottom flaps 113A and 113B, the flaps may comprise a single portion with a width about equal to a width of bottom panel 110. However, it is to be appreciated that the flaps of main blank 10 may comprise multiple portions and/or differing widths in accordance with some embodiments of the present invention.

For example, and without limitation, side panel 120 can have a flap formed of first portion 125A and second portion 123A on one end and first portion 125B and second portion 123B on an opposite end. Similarly, side panel 130 can have a flap formed of first portion 135A and second portion 133A on one end and first portion 135B and second portion 133B on an opposite end. As discussed more fully below, flaps having multiple portions may be used to form containers having non-right angled corners. And while the first and second flap portions of the example of FIGS. 1A-1B extend laterally from each other and from the panel, it is to be appreciated that in some embodiments of the present invention, the flap portions may have a side-by-side configuration. For example, and without limitation, a flap may include a first portion extending laterally from the panel and a second portion, adjacent but not connected to the first portion, also extending laterally from the first panel. As above, in some embodiments, the flaps may have smaller widths than the panel to which they are attached. For examples, and without limitation, top flaps 143A and 143B may have widths that are less than the width of top flap 140. Similarly, top flaps 153A and 153B may have widths that are less than the width of top flap 150. Flaps having widths less than that of the panels may be used to form containers having tucking, locking, or similar functional features. It is to be appreciated that the dimensions and configurations of the panels and flaps of main blank 10 are determined with reference to, among other things, the desired shape and functions of the container to be formed.

In some embodiments, the side support blank 20 can also include flaps extending from a main side support panel. For example, and without limitation, side support blank 20 can have a main panel 221, a first flap having a first portion 223A and a second portion 225A, and a second flap having a first portion 223B and a second portion 223B. As discussed more fully below, in some examples, and without limitation, a length of main panel 221 of side support blank 221 may be about equal to a width of the bottom panel 110 of main panel 10. It is to be appreciated that, while the exemplary side support blank 20 of FIGS. 1A-1B has multiple portions, each the same width as the main panel, other configurations of side support blanks are contemplated in accordance with some embodiments of the present invention. It is further to be appreciated that while side support blanks 20 is shown as having a length slightly larger than the width of the container to be formed (for example, the distance from an end of flap 223A to an end of flap 223B is greater than the width of bottom panel 110), in some embodiments, the side support blanks can have a length about equal to an inside circumference of the container to be formed. For example, and without limitation, side support blank 20 can be formed into a ring for circumscribing the bottom panel 110 of main blank 10.

In some embodiments, one or more flaps of the main blank and/or side support blank may be bent by between 30 and 90 degrees. For example, and without limitation, flaps 125A and 125B may be bent 30 degrees with respect to side panel 120 and flaps 123A and 123B may be bent 60 degrees with respect to flaps 125A and 125B. In other examples, and without limitation, bottom flaps 113A and 113B may be bent 90 degrees with respect to bottom panel 110. In other examples, and without limitation, flaps 225A and 225B may be bent 45 degrees with respect to main side support panel 221 and flaps 223A and 223B may be bent 45 degrees with respect to flaps 223A and 223B. It is to be appreciated that other angles of bends are contemplated in accordance with some embodiments of the present invention.

As illustrated in the exemplary illustrations of FIGS. 1A-1B, the container may be formed by folding and/or bending one or more panels or flaps of the main and side support blanks. It is to be appreciated, that the example of FIGS. 1A-1B and the discussion that immediately follows is for illustrative purposes and one or more changes may be made without departing from the scope of the present invention.

In some examples, and without limitation, the container may be formed by positioning one or more side support blanks 20, 30 perpendicularly against main blank 10. In some examples, and without limitation, the side support panels can be positioned such that an edge of main panel 221 of side support blank 20 is provided at the intersection of bottom panel 110 and bottom flap 113A. In some examples, and without limitation, the side support of the carton may be formed by bending the flaps of side support blank 20 (including, for example, and without limitation, portions 223A, 223B, 225A, and 225B) into a "C" shape. In some examples, one or more panels of main blank 10 (including, for example, and without limitation, side panels 120 and 130 and top panels 140 and 150) may be bent in a "C" shape around the formed side support. As such, it can be appreciated that the geometry and configuration of the side support blanks 20, 30 are to be selected such that, once formed, they may be tightly disposed between opposing side panels 120 and 130 of main blank 10.

In some examples, and without limitation, after side supports 20, 30 are formed and disposed within the partially bent main blank 10, side flap portions 123A and 125A of side panel 120 and side flap portions 133A and 135A of side panel 130 may be folded over main panel 221 of side support blank 20. Similarly, side flap portions 123B and 125B of side panel 120 and side flap portions 133B and 135B of side panel 130 may be folded over support blank 30.

In some embodiments of the present invention, and as discussed more fully below, and without limitation, the side flaps of the main blank 10 may be folded over, and held against, the formed side supports by folding members 311A, 311B, 311C, and 311D until bottom flaps 113A and 113B can be folded over the side flaps. Once folded, the bottom flaps and the side flaps of the main part can be compressed against the formed side support part to produce the formed container.

Figure 2:
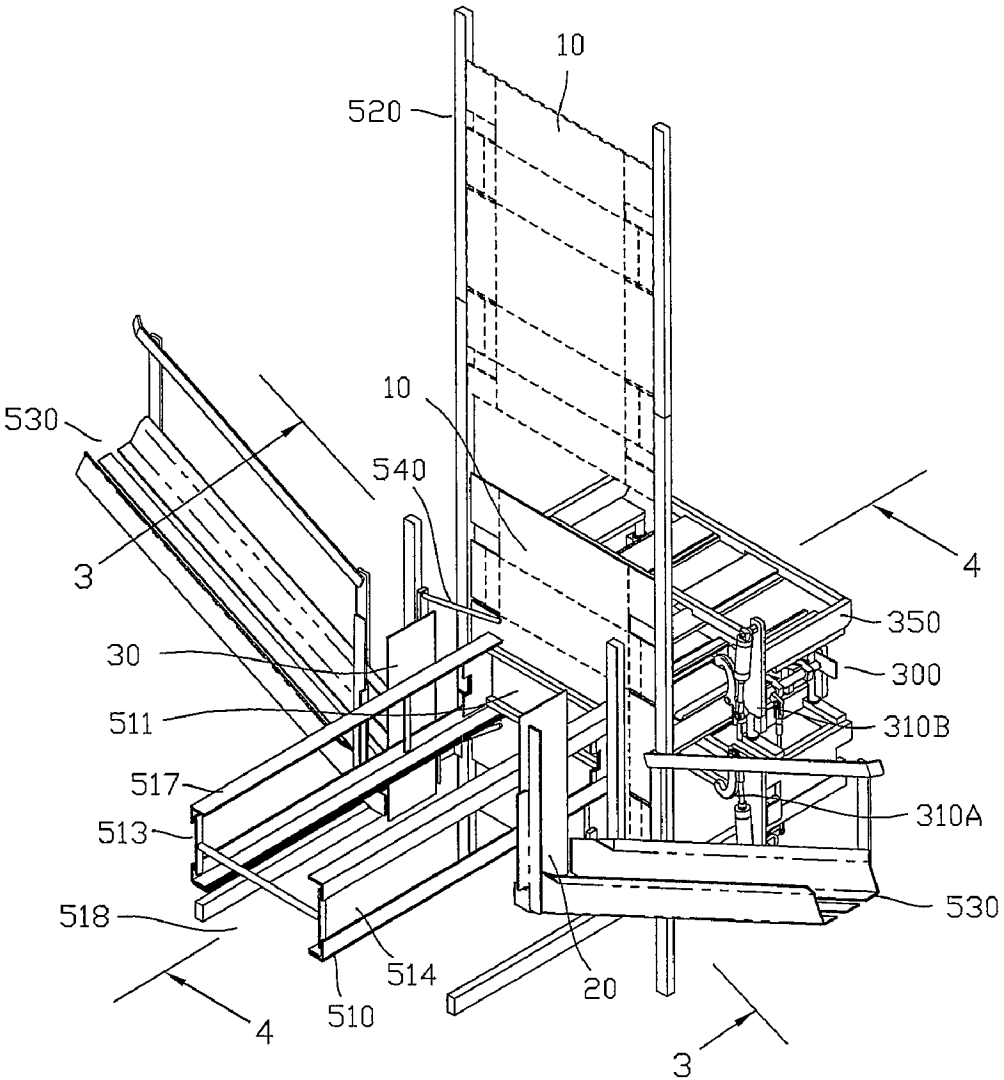
FIG. 2 is a diagram showing an exemplary system in accordance with some embodiments of the present invention.
Figure 3:
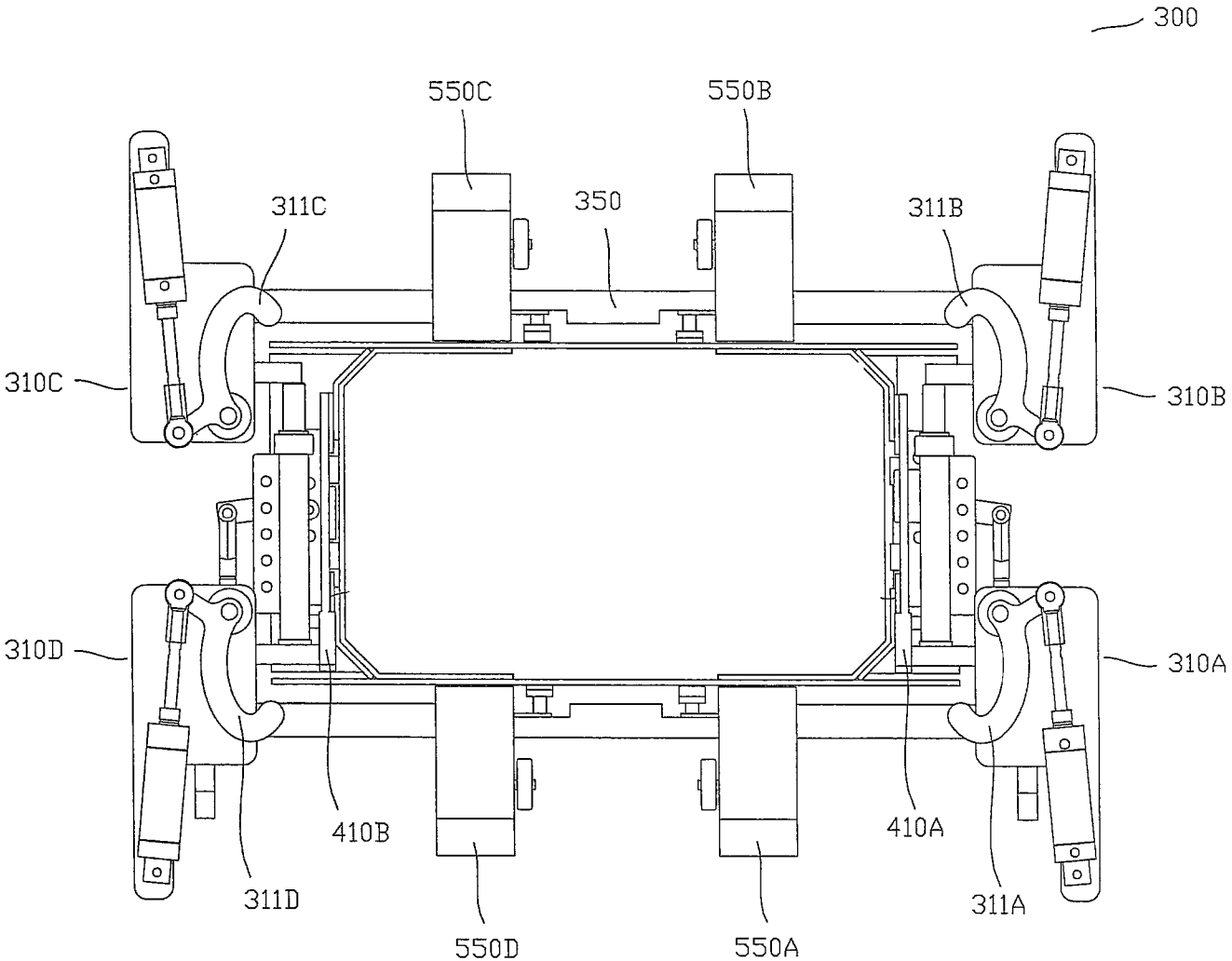
FIG. 3 is partial cut-away side view along the 3-3 lines of FIG. 2, in accordance with some embodiments of the present invention.
Figure 4:
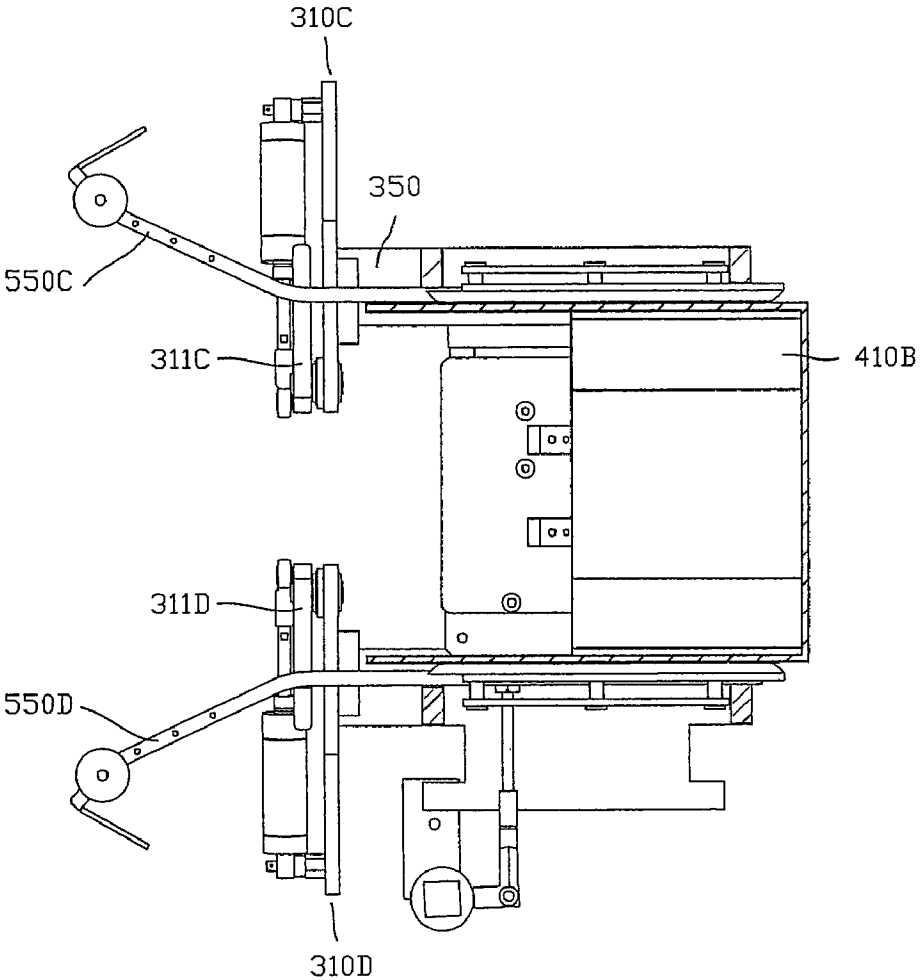
FIG. 4 is a partial cut-away side view along the 4-4 lines of FIG. 2, in accordance with some embodiments of the present invention.
Figure 7:
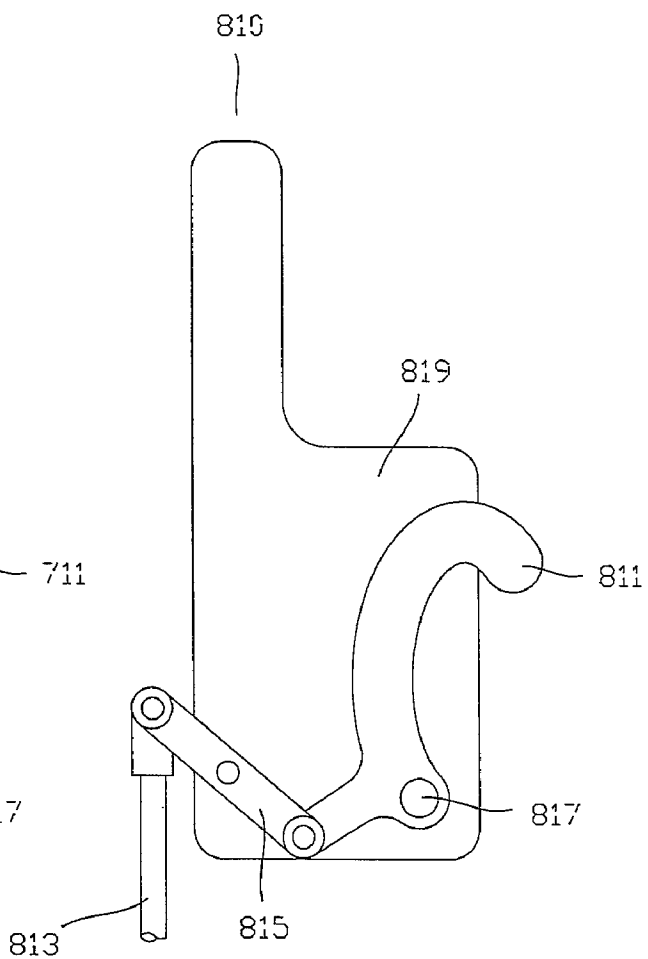
FIG. 7 is a diagram showing another exemplary folding member in accordance with some embodiments of the present invention.
Figure 6:
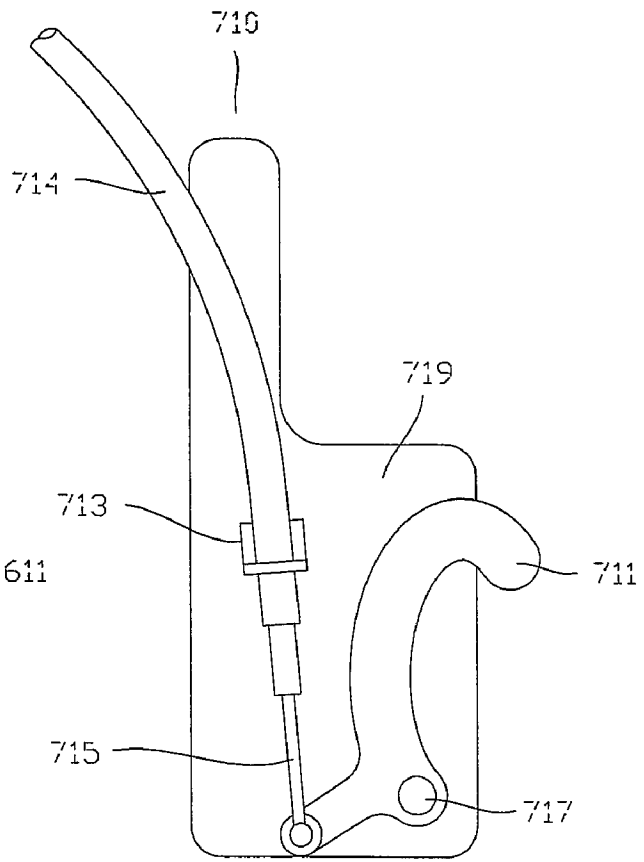
FIG. 6 is a diagram showing another exemplary folding member in accordance with some embodiments of the present invention.

Referring now to the exemplary illustrations of FIGS. 2-4, and without limitation, a container forming device can include an elongated mandrel 510 defining the inside dimensions and area of the containers to be formed. As illustrated, mandrel 510 can have a forward or distal side 511, a first pair of opposing sides 513, 514, and a second pair of opposing sides 517, 518. It is to be appreciated that the elongated dimension of mandrel 510 defines the depth of the container and the height and the width of mandrel 510 define the height and width of the container. For example, and without limitation, first pair of opposing sides 513, 514 may have a different separation distance than second pair of opposing sides 517, 518 for forming a rectangular container. In other examples, square containers may be formed by mandrels having first and second opposing sides with the same separation distance. In some examples, and without limitation, mandrel 510 can be removed and replaced with one of many other elongated mandrels having different height, width and depth dimensions, depending on the geometries of the container to be formed. In some examples, and without limitation, mandrel 510 can be formed of sturdy metal, such as aluminum. In some examples, and without limitation, mandrel 510 may slide on guides made of nylon or other similar material on a track underneath.

In some embodiments, mandrel 510 can be configured with cyclical or oscillating movement between a beginning and a end of a path. In some examples, and without limitation, mandrel 510 can be attached to one end of a movable lever by means of pivotally attached rod. The opposite end of the lever can be pivotally attached through a set of linkages to a pivot. The cam can cause the linkages to impart a back and forth motion to the lever as it rotates around the pivot. It can be appreciated that in such examples, the rod can pull the mandrel back and forth along a track. It is within the abilities of those in the art to implement other means for imparting oscillating motion to the mandrel in accordance with some embodiments of the present invention.

In some embodiments, devices can include one or more hoppers 530 for providing side support blanks 20, 30 of the container to be formed on sides 513, 514 of mandrel 510. In some examples, and without limitation, the hoppers may include generally L-shaped flanges of varying lengths in order to hold large or small quantities of side support blanks. In some examples, and without limitation, hoppers 530 can be configured with a position such that in operation, main panel 221 of side support part 20 can be aligned with side 514 of mandrel. In some embodiments, the flaps of side support blank 20 may be bent around one or more adjacent sides of the mandrel by one or more plows. For example, and without limitation, plow 540 may be provided between hoppers 530 and feeder 520 for bending a top flap of side support blank 30 around side 517. A second plow (not shown) may be provided for bending a bottom flap of side support blank 30. As such, it can be appreciated that by providing two plows, a support blank such as support blank 20 can be formed into a "C" shape wherein main portion 221 is adjacent to side 514 of mandrel 510, the top flap (which may include flaps 223A, 225A) is adjacent to side 517 of mandrel 510, and bottom flap (which may include flaps 223B, 225B) is adjacent to side 518 of mandrel 510.

In some embodiments, devices can include feeder 520, in a forward location from hoppers 530, for providing the main blank 10 of the container to be formed on the forward side 511 of mandrel 510. In some examples, and without limitation, feeder 520 can be configured with a position such that in operation, bottom panel 110 of main blank 10 is aligned with the forward side 511 of mandrel 510. In some embodiments, additional plows may be provided for bending side panels 120 and 130 of main blank 10 around adjacent sides of the mandrel. For example, and without limitation, plow 550C (shown in FIG. 4) may be provided directly behind feeder 520 for bending side panel 120 of main blank 10 around side 517 of mandrel 510. A second plow 550D may be provided for bending side panel 130. As such, it can be appreciated that by providing at least two plows, main blank 10 can be formed into a "C" shape wherein bottom panel 110 is adjacent to front side 511 of mandrel 510, side panel 120 (and optionally top panel 140) is adjacent to side 517 of mandrel 510, and side panel 130 (and optional top panel 150) is adjacent to side 518 of mandrel 510.

It is to be appreciated that the interaction between, and operation of, mandrel 510, feeder 520, hoppers 530, plows 540, and 550A-D is sufficient to (i) form support blanks 20, 30 around the mandrel, (ii) align forward edges of the formed support parts against bottom panel 110 of main blank 10, and (iii) partially form side panels 120, 130 of main blank 10 around the formed support parts. It is within the abilities of those in the art to implement devices having other types and configurations of hoppers, feeders, and plows in accordance with some embodiments of the present invention.

In advantageous embodiments, devices may further include one or more folding assemblies, members, plows, and/or plates for bending and/or folding the side and/or bottom flaps of the main blank. As shown in the exemplary illustration of FIGS. 1A-1B, after main blank 10 is formed into a "C" shape, the side flaps of side panels 120, 130 and the bottom flaps of bottom panel 110 remain to be folded over the formed side supports. It is to be appreciated that, in some examples, and without limitation, bottom flaps 113A, 113B extend outwardly past the main panel of the formed side support parts. For this among other reasons, fixed position plows (similar to, for example, plows 540) can not be used to bend the side panels around the formed side support parts. Thus, in some embodiments, devices can include retractable members for folding or "tucking" the side panels.

Referring back to the exemplary illustrations of FIGS. 2-8, specifically to FIGS. 3 and 4, devices can include a folding assembly having at least one folding member directly behind plows 550A-D. In some examples, and without limitation, the folding assembly can include a plurality of extendable folding elements 310A-D generally configured to extend for folding the side flaps of the side panels inward towards the formed side support parts. In some examples, and without limitation, the assembly may include a frame 350 having an opening sized for receiving mandrel 510 there through. In some examples, and without limitation, folding members 310A-D may be connected to and supported by frame 350. In some examples, and without limitation, plows 550A-D may additionally be connected to and supported by frame 350. In some examples, and without limitation, frame 350 may be connected to feeder 510.

Figure 5:
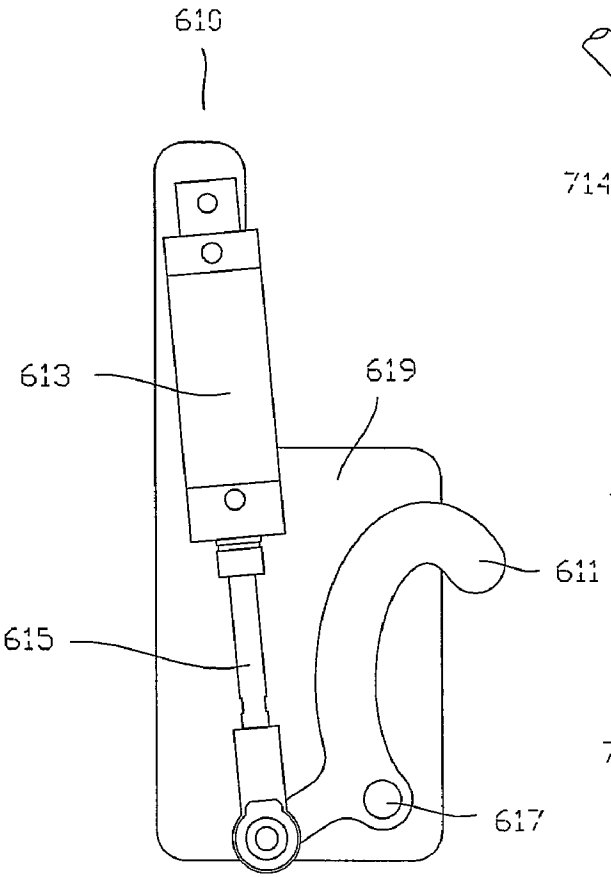
FIG. 5 is a diagram showing an exemplary folding member in accordance with some embodiments of the present invention.

In some embodiments, referring to the example of FIG. 5, and without limitation, folding element 610 can include finger 611 operatively engaged with cylinder 613 though piston 615 via pivot point 617. In some examples, and without limitation, cylinder 613 and/or pivot point 617 can be engaged with plate 619 for attachment to frame 350. In some examples, and without limitation, cylinder may include air or a pneumatic fluid, such as oil. In some other embodiments, referring to the example of FIG. 6, and without limitation, folding element 710 can include finger 711 operatively engaged with cable 714 having rigid wire 715 via pivot point 717. In some other embodiments, referring to the example of FIG. 7, and without limitation, folding element 810 can include finger 811 operatively engaged with rod 814 and linkage 815 via pivot point 817. In operation, activation of cylinder 613 (of FIG. 5), cable 714 (of FIG. 6), or rod 813 (of FIG. 7) moves a distal end of the finger in an inward direction bringing the finger into contact with the side flaps of the main blank.

In some examples, and without limitation, the fingers can be formed of nylon, plastic, or metal. In preferred embodiments, the fingers have a rounded distal portion (for example, and without limitation, a curved surface or a freely rotating wheel) for contacting the side flaps. In some embodiments, the fingers may be easily removable and replaceable in order to effectively fold and accommodate different sized containers to be formed.

Figure 8:
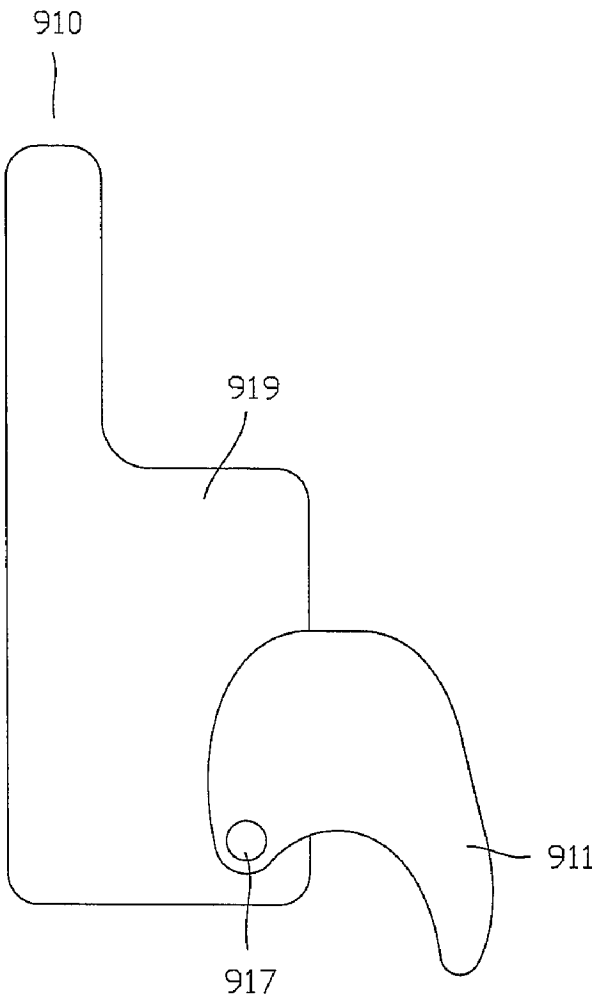
FIG. 8 is a diagram showing another exemplary folding member in accordance with some embodiments of the present invention.

In some other embodiments, referring to the example of FIG. 8, and without limitation, folding element 910 can include rotating arm 911 operatively engaged with rotating means 917. In some examples, and without limitation, rotating means 917 can be a rotor of a DC servo motor (not shown). In other examples, rotating means 917 can be a shaft coupled to a gear assembly in communication with a belt or chain drive (not shown). In operation, activation of rotating means 917 causes rotating arm 911 to rotate in a circular fashion, bringing a distal end of the arm into contact with side flaps of sequential main blanks to be formed. It is to be appreciated that other folding elements are contemplated in accordance with some embodiments of the present invention.

Referring back to FIG. 3, it can be appreciated that the size of fingers 311A-D and the placement and configuration of folding elements 310A-D are, in part, a function of the dimensions of the side and bottom flaps of the main blank 10. For example, and without limitation, when the folding elements 310A-D are fully retracted (as shown), the distal ends of fingers 311A-D should not prevent the yet unfolded bottom flaps 113A, 113B of the main blank 10 from passing thereby. Preferably, the fingers 311A-D of folding elements 310A-D are configured in retracted positions until after bottom flaps 113A, 113B pass thereby (as shown in the illustration of FIGS. 1A-1B). Thereafter, the fingers 311A-D of folding elements 310A-D may be extended to fold the side flaps inward towards the formed side support parts.

In some embodiments, the folding elements may be retracted from their extended positions after the side flaps are partially folded over the side support parts. In these examples, other means may be provided to finish folding the side panels over the side support part. For example, and without limitation, the folding elements may fold the side flaps about 45 degrees towards the side support parts and a plow or other bending structure may complete the fold. In some other embodiments, the folding elements may be retracted from their extended positions after the side flaps are fully folded over the side support parts (which in some examples, and without limitation, corresponds to about 90 degrees). In these examples, no other plow or bending structure may be necessary to complete the fold.

In some embodiments, the folding elements may be retracted immediately after folding the side flaps. In some other embodiments, the folding elements may remain in extended positions until the bottom flaps 113A, 113B are partially or fully folded over the side flaps. In some examples, and without limitation, the folding elements can remain in the extended position for holding the bent side flaps until the bottom flaps of the bottom panel can be fully or partially bent thereon. In some examples, and without limitation, the bottom flaps may be bent over the side portions by a plurality of plows (not shown).

In some embodiments, devices for forming a container may also include one or more compression plates for sealing the bottom flaps and the side flaps to the side support parts. In some examples, and without limitation, one or more surfaces of the side support part, the side flanges, and the bottom flanges may be sprayed with an adhesive. The squeezing action of the compression plates against the mandrel causes the adhesive to bond the ends of the container. As illustrated in the example of FIGS. 2-4, and without limitation, compression plates 410A, 410B may be located forward of the folding assembly and at sides 513, 514 of mandrel 510. In some embodiments, and without limitation, after the bottom flaps have been bent around the side flaps by plows, compression plates 410A, 410B may collapse against the sides of mandrel 510 tightly squeezing the flaps against the side support parts. In some other embodiments, the edges of the compression plates themselves may perform the function of plows, causing the bottom flaps to bend over the side flaps. In some examples, and without limitation, compression plates 410A, 410B may be formed of a non-stick material in order to avoid adhesion to the bottom flaps of the main blank. In some examples, and without limitation, the compression plates 410A, 410B may be activated using pistons or other similar hydraulic devices. Following compression, the now-formed container may be removed from the machine.

Thus, the present invention provides apparatuses, systems, and methods for constructing a container having a main part with side and bottom flaps, wherein the side flaps may be folded over one or more side support parts positioned inside the container, without impeding movement of the container on said mandrel caused by yet unfolded bottom flaps. It is to be understood that variations, permutations, and modifications of the present invention may be made without departing from the scope thereof. As such, one or more features of some exemplary embodiments as described above may be practiced in conjunction with some other exemplary embodiments. It is also to be understood that the present invention is not to be limited by the specific embodiments disclosed herein or as illustrated in the referenced drawings, but rather, is defined in accordance with the appended claims when read in light of the foregoing specification.

What is claimed is:

1. A method for forming a container from (i) a main blank having at least two side panels with side flaps and a bottom panel having bottom flaps, and (ii) at least two support blanks, said method comprising the steps of:

a) moving a mandrel forward along a path inside a machine;

b) engaging said support blanks on first opposing sides of said mandrel as said mandrel travels forward on said path;

c) engaging said bottom panel on a front side of said mandrel as said mandrel travels forward on said path such that an edge of each said support blank is aligned against said bottom panel;

d) bending said side panels against second opposing sides of said mandrel with at least one plow as said mandrel travels forward on said path, wherein said second opposing sides of said mandrel are generally perpendicular to said first opposing sides of said mandrel;

e) after said side panels are bent, bending said side flaps against said support blanks by a plurality of folding members having extended and retracted positions; and f) after said side flaps are bent, bending said bottom flaps against said side flaps while said plurality of folding members have said extended positions.

2. The method of claim 1, further comprising the step of applying a compressing force to said bottom flap, said side flaps, and said support blank by a compression plate.

3. The method of claim 2, further comprising the step of retracting said folding members after said compression plate has applied said compression force.

4. The method of claim 1, wherein said bottom flap is folded over said side flap by one of the group consisting of a front edge of said compression plate, at least one plow, and combinations thereof.

5. The method of claim 1, said step of engaging said support blanks on said first opposing sides of said mandrel comprising the steps of placing each of said support blanks on at least one of said first opposing sides of said mandrel by a hopper and bending said support blank against at least one adjacent side of said mandrel.

6. The method of claim 1, said step of engaging said bottom panel on said front side of said mandrel comprising the steps of placing said bottom panel of said main blank in the path of said front of said mandrel by a feeder.

7. The method of claim 1, wherein said step of bending said side flaps comprises the steps of extending said folding members to contact outside surfaces of said side flaps, further extending said folding members in a direction towards said support members, and holding said side flaps against said support members until said bottom flaps of said bottom panel are folded over said side flaps.

8. The method of claim 7, further comprising the step of retracting said folding members after said bottom flaps are folded over said side flaps.

9. The method of claim 1, each said folding member comprising a finger rotatable around a pivot point on said finger, wherein said step of bending said side flaps comprises extending said fingers by rotating said fingers around said pivot points.

10. The method of claim 1, wherein said step of bending said bottom flaps comprises causing inside surfaces of said bottom flaps to overlap outside surfaces of said side flaps and outside surfaces of said support blanks.

11. A method for forming a container from (i) a main blank having at least two side panels with side flaps and a bottom panel with bottom flaps, and (ii) two support blanks, said method comprising the steps of:

a) first, engaging said support blanks on first opposing sides of a mandrel movable along a path inside a machine by placing said support blanks on said opposite sides of said mandrel by a hopper and bending each of said support blanks against adjacent sides of said mandrel;

b) then, engaging said bottom panel on a front of said mandrel by placing said bottom panel in the path of said mandrel moving in a forward direction by a feeder, wherein forward edges of said support blanks are aligned against an inside surface of said bottom panel;

c) then, bending said side panels against second opposing sides of said mandrel with at least two plows as said mandrel travels forward on said path, wherein said second opposing sides of said mandrel are generally perpendicular to said first opposing sides of said mandrel;

d) then, bending said side flaps against said support blanks by extending a plurality of retractable members to contact outside surfaces of said side flaps and further extending said retractable members in a direction towards said support blanks; and e) then, while maintaining said retractable members in an extended position, folding said bottom flaps over said side flaps and compressing said bottom flaps, said side flaps, and said support blanks.

12. The method of claim 11, each said retractable member comprising a finger rotatable around a pivot point on said finger, wherein said step of extending said retractable members comprising rotating said fingers around said pivot points.

13. The method of claim 12, wherein said step of bending said side flaps comprises contacting said side flaps with distal ends of said fingers and pushing said side flaps towards said support blanks.

14. The method of claim 11, wherein said step of folding said bottom flaps comprises causing inside surfaces of said bottom flaps to overlap outside surfaces of said side flaps and outside surfaces of said support blanks.

15. A method for forming a container from (i) a main blank having at least two side panels each having at least two side flaps and a bottom panel having at least two bottom flaps and (ii) at least two side support blanks having a main panel and at least two flaps, said method comprising the steps of:

a) first, bending said flaps of said side support blanks at angles of between about 30 degrees to about 90 degrees;

b) then, aligning edges of said side support blanks against an inside surface of said bottom panel of said main blank;

c) then, bending said side panels of said main blank at angles of between about 30 degrees to about 90 degrees, wherein inside surfaces of said side panels are flush against outside surfaces of said flaps of said side support blanks;

d) then, bending said side flaps of said main blank at angles of between about 30 degrees to about 90 degrees, wherein inside surfaces of said side flaps are flush against outside surfaces of said main panels of said side support blanks;

e) then, bending said bottom flaps of said main blank at angles of between about 30 degrees to about 90 degrees, wherein inside surfaces of said bottom flaps are flush against outside surfaces of said side flaps of said main blank.

16. The method of claim 9, wherein said step of bending said side flaps comprises contacting said side flaps with distal ends of said fingers and pushing said side flaps towards said support blanks.

17. The method of claim 15, wherein said step of bending said bottom flaps comprises causing inside surfaces of said bottom flaps to overlap outside surfaces of said side flaps and outside surfaces of said main panels of said side support blanks.

18. A method of forming a container from (i) a main blank having at least two side panels each having at least two side flaps and a bottom panel having at least two bottom flaps and (ii) at least two side support blanks having a main panel and at least two flaps, said method comprising the steps of:

a) first, bending said flaps of said support blanks and said side panels of said main blank such that inside surfaces of said side panels of said main blank are flush against outside surfaces of said flaps of said support blanks;

b) then, bending said side flaps of said side panels such that inside surfaces of said side flaps of said side panels are flush against outside surfaces of said main panels of said support blanks; and c) then, bending said bottom flaps of said bottom panel such that inside surfaces of said bottom flaps are flush against outside surfaces of said side flaps and outside surfaces of said main panels of said support blanks.

19. The method of claim 18, wherein said step of bending said side flaps of said side panels comprises causing distal ends of fingers of a plurality of retractable members to contact said side flaps and push said side flaps towards said main panels of said support blanks.

20. The method of claim 19, wherein said distal ends of said fingers remain in contact with said side flaps until said bottom flaps are bent over said side flaps.

* * * * *